United States Patent [19]

Helderman

[11] Patent Number: 4,969,304

[45] Date of Patent: Nov. 13, 1990

[54] IMMEDIATELY ACCESSIBLE WALL AND CEILING SYSTEM

[76] Inventor: James F. Helderman, 414 S. Maple St., Graham, N.C. 27253

[21] Appl. No.: 391,135

[22] Filed: Aug. 8, 1989

Related U.S. Application Data

[63] Continuation-in-part of Ser. No. 197,291, May 23, 1988, abandoned.

[51] Int. Cl.[5] ..... E04B 9/10

[52] U.S. Cl. ..... 52/780

[58] Field of Search ..... 52/780, 781, 484, 488, 52/508, 509

[56] References Cited

U.S. PATENT DOCUMENTS

| | | | |
|---|---|---|---|
| 3,475,869 | 11/1969 | Jahn | 52/484 |
| 3,965,636 | 6/1976 | Huber | 52/484 |
| 4,384,437 | 5/1983 | Coles | 52/484 |
| 4,516,373 | 5/1985 | Osawa | 52/488 |
| 4,769,965 | 9/1988 | Shaub | 52/488 |

*Primary Examiner*—John E. Murtagh

*Attorney, Agent, or Firm*—Olive & Olive

[57] ABSTRACT

A wall and ceiling furring and panel system for an interior side or ceiling wall of a building utilizes parallel furring strips and other panel supporting components which are fixed to the frame members of the wall and which provide panel support surfaces one of which is of relatively narrow width and the other of which is of relatively wide width. Immediate access to plumbing, wiring or other utilities behind the wall or above the ceiling is gained by sliding or lifting a panel to provide an opening at the desired point of entry. The system is adaptable for use with any conventional wallboard and with wood or metal studs.

10 Claims, 8 Drawing Sheets

IMMEDIATELY ACCESSIBLE WALL AND CEILING SYSTEM

BACKGROUND OF THE INVENTION

1. Relation to Copending Application

This application forms a continuation-in-part of copending application Ser. No. 07/197,291 filed May 23, 1988 entitled "Removable Wall Panel System," now abandoned.

2. Field of Invention

The invention relates to a building construction system for establishing interior room sidewalls and ceilings with panels and a unique panel support system which permit the panels to be easily removed or repositioned to provide immediate work access to areas covered by the panels.

3. Background Art

Computer, burglar alarm, air conditioning, low voltage lighting and similar wiring systems as well as plumbing systems promote the need for sidewalls and overhead ceilings made up of removable panels. Modern buildings have been reported as having a life expectancy of around 75 years, but a buildings' utilities (plumbing, electric, air, heat, etc.) must be modernized or replaced about every 20 years. This means that the utilities must be revamped two or three times during the life of a building. Telephone, dictating and computer lines also require modifications. Retrofitting of utilities or selected utilities for the purpose of modernizing is a very common practice. The typical sidewall is not made of removable panels even though ceilings are often constructed with removable ceiling tiles supported on suspended frames. However, the typical ceiling tile must be substantially tilted upwardly to be removed which in turn requires that substantial tilt space be available above the normal plane of the ceiling. It would thus be desirable to be able to install and remove panels with only slight movement and slight tilting or sliding of the panel in a ceiling or sidewall construction to provide immediate accessibility to the utilities and to the various circuits, pipes, lines and the like hidden by the ceiling or sidewall.

Conventional suspended ceiling systems utilize wire hangers which are easily bent and misaligned. In some instances a special edge treatment is required as for example in the October, 1968 German Pat. No. 1,409,938. The removable plates or panels as in the cited German patent are typically required to be spaced a substantial distance from the supporting structure which eliminates the possibility of direct contact with the supporting structure. The system of the German patent furthermore is adapted only to ceilings and not to sidewalls, leaves a visual gap, provides corner rather than edge support and requires alignment adjustments, all of which disadvantages are sought to be eliminated by the present invention.

Sliding door panels have been known to rest in one lower relatively shallow track and have the upper edge rest in another upper and somewhat deeper track. This arrangement illustrated in FIG. 1 allows the panels to be captured by the tracks in normal use but to be easily removed by lifting the panel into the upper track and slightly tilting the panel out of the lower track. However, so far as is known no one has heretofore recognized the possibility of forming furring strips, chair rails, baseboards and crown moldings with deep and shallow rabbets or channels to permit immediate access behind a sidewall or above a ceiling wall.

The invention seeks to provide an improved wall and ceiling system having easily removed and easily repositionable panels held between relatively shallow and relatively deep rabbets or channels formed by furring strips or other building components and which require only a slight sidewise and slight tilting or a sliding motion to be removed or to expose a work area. Other objects will become apparent as the description proceeds.

SUMMARY OF THE INVENTION

A wall and ceiling system for constructing an entire or at least a major portion of a sidewall or ceiling wall according to one aspect of the invention uses specially formed furring strips having on one side a relatively shallow rabbet or channel and on the opposite side a rabbet or channel which is preferably at least twice as deep. The furring strips can be arranged either horizontally and parallel or vertically and parallel in a wall construction and are typically secured to frame members such as overhead ceiling rafters or to the studs forming the wall. Thus, the system of the invention can be adapted to either a ceiling wall or a sidewall. The panels have straight edges on all sides. When the furring strips are arranged horizontally, the lower edge of each panel effectively rests in a shallow rabbet or channel whereas the upper edge of the panel effectively rests in a relatively deep rabbet or channel. In the application in which the furring strips are secured in parallel, vertical relation in a sidewall construction, the straight side edges of the panel effectively rest respectively in the shallow rabbet or channel of one furring strip and the relatively deep rabbet or channel of another furring strip. For application to a ceiling construction, the furring strips are secured in horizontal, parallel relation and the panels rest between the relatively deep rabbet or channel of one furring strip and the relatively shallow rabbet or channel of another furring strip. In all instances, an individual panel is easily removed by moving the panel toward the deeper rabbet or channel and then slightly tilting the panel out of the relatively shallow rabbet or channel. The referred to furring strip may be formed of wood, metal or plastic material and may be molded, extruded or roll formed. The resulting sidewall or ceiling wall leaves no visual gap since the furring strips are shaped so as to hide the edges of the panels.

In another aspect of the invention, the furring strips are designed so that one panel can slide over another panel to provide immediate access to a desired work area.

In a still further aspect of the invention, crown, chair rail and baseboard moldings are formed with the rabbet configuration of the invention and thus permit entire sidewalls to be accessible at any selected work area location.

Various other aspects of the invention will appear as the description proceeds.

DETAILED DESCRIPTION OF THE INVENTION, AND PREFERRED EMBODIMENTS THEREOF

Figure 1:
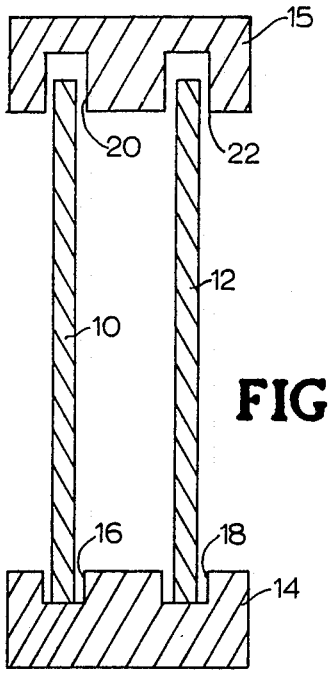
PRIOR ART FIG. 1
FIG. 1 is a sectional view of a prior art door panel-track system.

Making reference to the drawings, FIG. 1 illustrates a prior art construction in which sliding door or window panels 10, 12 are mounted between a lower frame support 14 having relatively shallow recesses or grooves 16, 18 and an upper frame support 15 having relatively deep recesses or grooves 20, 22. Panels 10, 12 are removed by lifting the respective panel further into the respective upper deep recess and tilting it out of the respective shallow recess. However, neither furring strips, moldings or other building components have been designed so far as applicant is aware to operate in this manner.

With the foregoing background in mind, numerous examples of the invention are shown to illustrate versatility of the invention. A first embodiment of the invention is initially explained in reference to FIGS. 2–8. One aspect of a principal form of the invention is the use of a furring strip 24 having a T-shaped body 26 in cross-section (FIG. 5) with a relatively shallow rabbet 28 disposed opposite a relatively deep rabbet 30. In one embodiment in which 3/16" thick panels were mounted, dimension X was ⅜" and dimension Y was ¾." Dimension Y should always be at least twice the width of dimension X. Dimension Z when greater than the thickness of two panels permits sliding of one panel over another as later illustrated and explained. The appended portion 25 provides panel retaining surfaces 27, 29 perpendicular to the coplanar panel support surfaces 21, 23 (FIG. 5).

Figure 4:
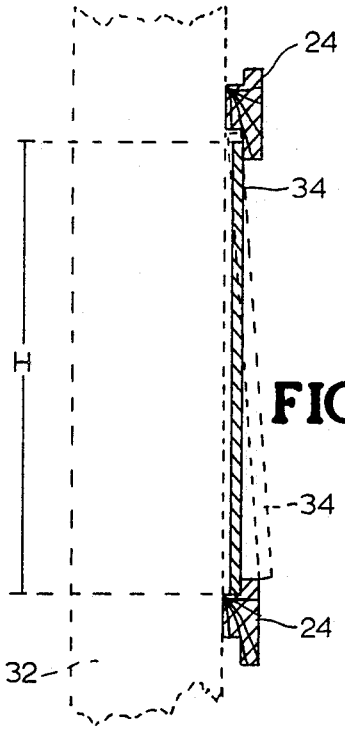
FIG. 4 is a sectional view taken generally on line 4—4 of FIG. 3.
Figure 2:
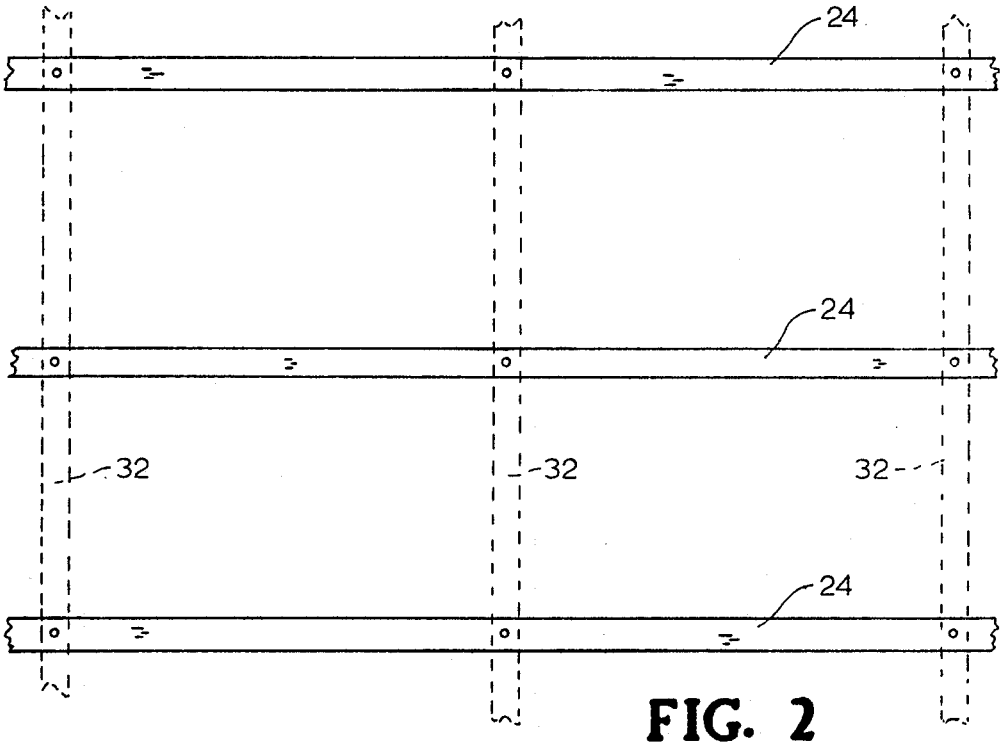
FIG. 2 illustrates a set of vertical building studs, indicated in dashed lines, with horizontal furring strips in solid lines formed and secured according to the invention.
Figure 3:
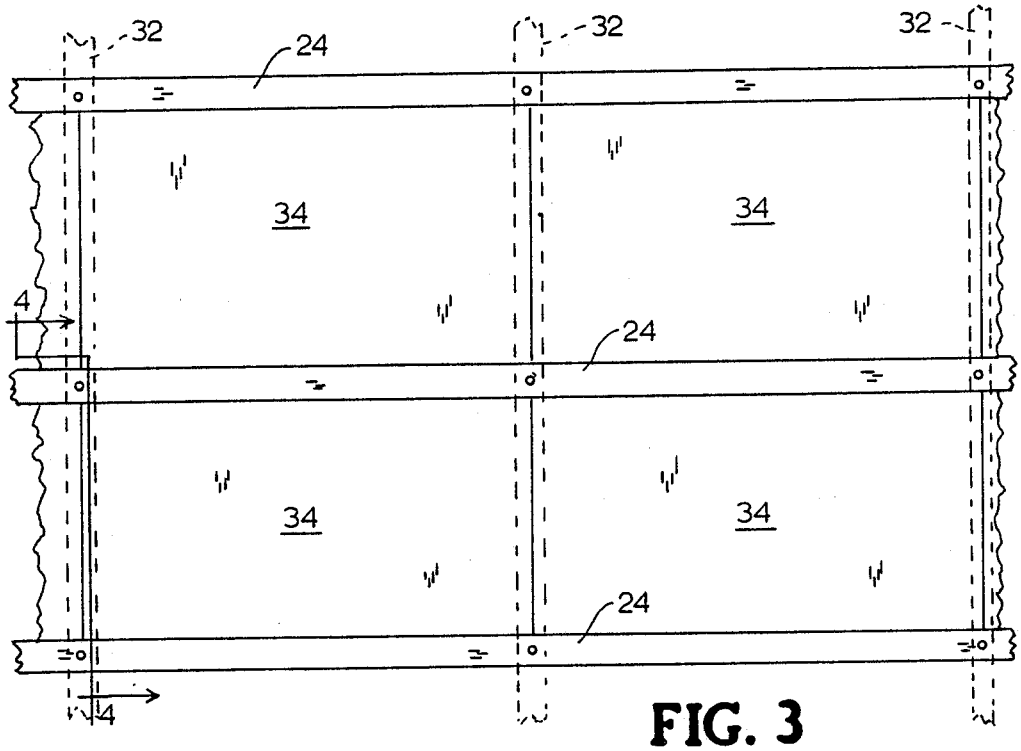
FIG. 3 illustrates the vertical studs and horizontal furring strips of FIG. 2 with horizontal wall panels installed and the furring strips exposed.

In FIG. 2, furring strips 24 are shown mounted directly on vertical building studs 32, illustrated in dashed lines, in a parallel, horizontal, vertically spaced relation. The relatively shallow, continuous, straight rabbet 28 of each furring strip 24 in FIG. 2 receives and removably and directly supports the straight lower edge of the removable panels 34 whereas the relatively deep rabbet 30 of each furring strip 24 retains and hides from external view the straight upper edge of the respective panels 34 as best seen in FIGS. 3 and 4. No visual gaps are apparent. Panels 34 are thus easily removed by lifting the respective panel into the respective upper relatively deep rabbet 30 so as to enable the panel to tilt slightly and clear the relatively shallow rabbet 28 as indicated in dashed lines 34 in FIG. 4. The height H (FIG. 4) of panel 34 is of course selected to facilitate this ease of removal.

Figure 7:
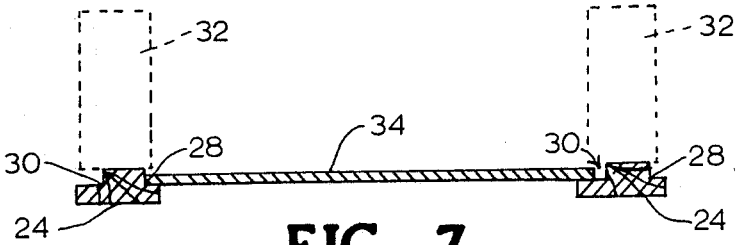
FIG. 7 illustrates furring strips of the type seen in FIG. 5 mounted vertically on the studs.

In all embodiments, the panels 34 are formed with straight edges on all sides thus eliminating the need for any special edge treatment of the panel. Also to be observed is that in each embodiment utilizing the furring strips of FIG. 5, each pair of furring strips, whether oriented horizontally as in FIG. 2 or vertically as in FIG. 7 provide an opposed pair of continuous, parallel, coplanar, panel retaining surfaces one of which surfaces is relatively wide and one of which is relatively narrow and both of which have an appended retaining surface perpendicular thereto. From the outside, the viewer sees a gap free surface whether looking at a sidewall or a ceiling wall constructed according to the invention. Also to be noted and emphasized is that the same basic system of components can be used for constructing an immediately accessible gap free, sidewall or an immediately accessible gap free, ceiling wall.

Figure 5:
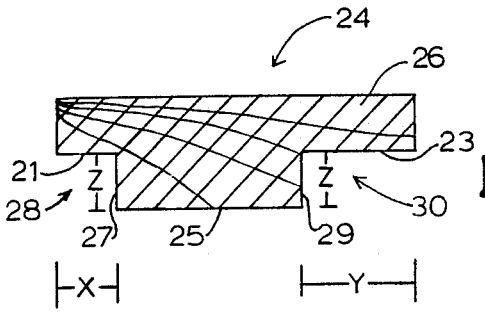
FIG. 5 is an end cross-sectional view of the type of furring strip used in the embodiment of the invention as seen in FIGS. 2–8.
Figure 6:
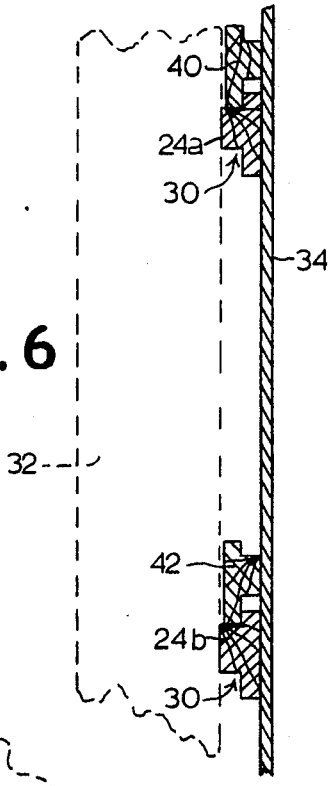
FIG. 6 illustrates in a sectional view an embodiment in which the panels are fitted with furring strips of the type illustrated in FIG. 5 and are arranged such that all the furring strips are hidden after the panels are installed.

FIG. 6 represents an alternative application for the FIG. 5 strip in which a pair of furring strips 40, 42 are secured to the rear of each panel 34 and rest on furring strips 24*a*, 24*b* secured to the frame members. Upper strip 40 normally rests in a relatively shallow rabbet of strip 24*a* whereas lower strip 42 normally rests in a relatively shallow rabbet of strip 24*b*. The panel 34 is removed by slight upward movement and outward tilting of the panel. All of the furring strips in FIG. 6 are of the FIG. 5 form and are hidden from view when in use. The system of FIG. 6 thus has the advantage of utilizing only one type strip with panel 34 being supported on strips 24*a*, 24*b* through strips 40, 42.

FIG. 7 represents a further application of the FIG. 5 type strip in which the furring strips 24 are positioned vertically and parallel on studs 32. Panels 34 are releasably retained between the relatively shallow rabbet 28 and relatively deep rabbet 30. The panel is removed by a slight lateral sidewise motion followed by outward tilting.

Figure 8:
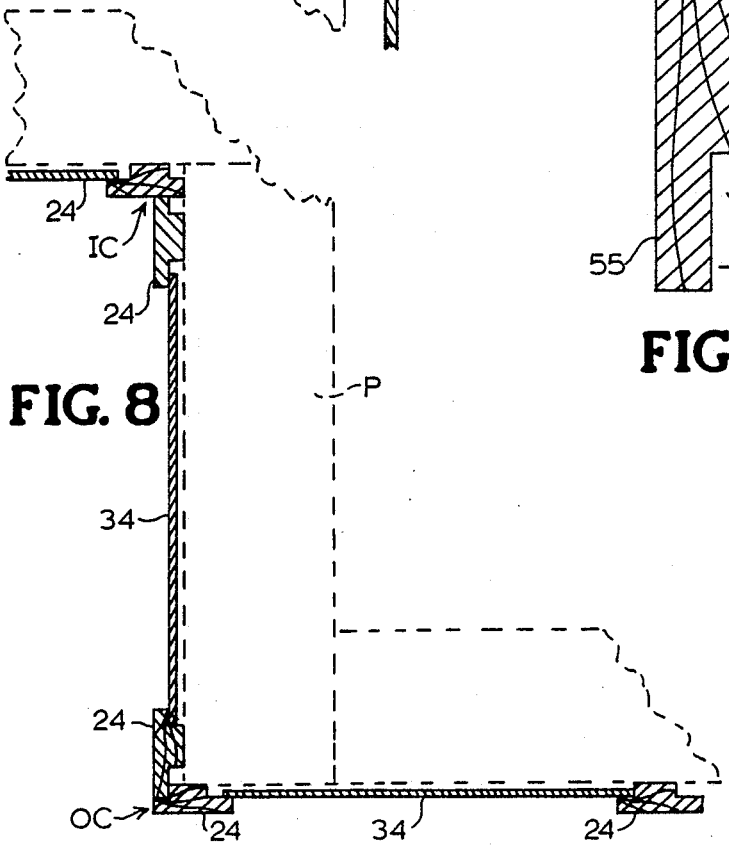
FIG. 8 illustrates furring strips of the type illustrated in FIG. 5 arranged for accommodating either inside or outside and either vertical or horizontal corners during construction.

FIG. 8 illustrates the adaptability of the invention to either an inside corner labeled IC or an outside corner labeled OC when the furring strips 24 are mounted vertically as in FIG. 7. P is used to designate the conventional top plate shown in dashed lines, on the top of the studs and which may itself be formed from a stud. In addition to being adapted to inside and outside corners, the FIG. 8 arrangement also readily lends itself to either vertical corners as in FIG. 8 or horizontal corners.

Figure 9:
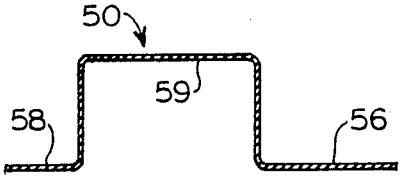
FIG. 9 illustrates in an end cross-sectional view another type furring strip suited to being formed of relatively strong and rigid sheet metal.

FIG. 9 represents a uniquely designed furring strip 58 having a relatively deep panel supporting shelf 56 and a relatively shallow panel supporting shelf 58 and a central portion 59 for receiving nails, screws or other fasteners. In this example, when used for a ceiling wall, each panel 34 is designed to have one edge rest in the relatively shallow shelf 58 of one strip 50 with the opposite edge of the panel designed to rest in the relatively deep shelf 56 of another strip 50. The panel is removed by slight upward movement and outward tilting.

Figure 10:
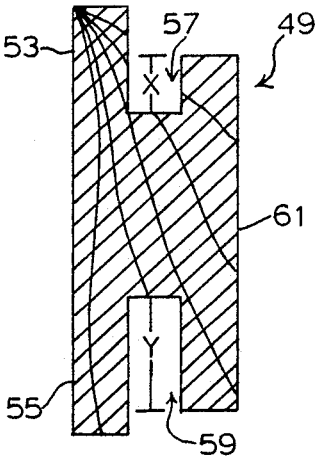
FIG. 10 is an end H-shaped cross-sectional view of a still further type furring strip suited to being formed of wood, extruded or molded.

The FIG. 10 form of strip 49 provides a channel 57 of shallow depth X substantially half the depth of the relatively deep channel 59 of depth Y. A plurality of strips 49 fixed to the frame members and run horizontally as in FIG. 3 would enable the lower edge of an upper panel to be captured by a shallow channel 57 and the upper edge of a lower panel to be captured by a deep channel 59 and with the outer strip surface 61 exposed to view. The form in which strip 49 is illustrated would lend itself to being formed of wood or of being molded or extruded.

Figure 11:
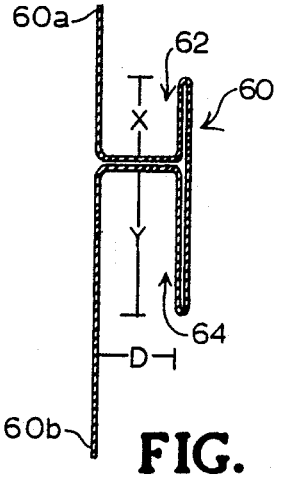
FIG. 11 is an end cross-sectional view of another metal cold roll-formed type of furring strip suited to the invention and generally of the FIG. 10 H-shape configuration.
Figure 21:
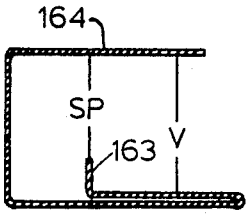
FIG. 21 is a sectional view of a cold-rolled-formed metal ceiling wall furring strip used in the construction of FIG. 22.
Figure 31:
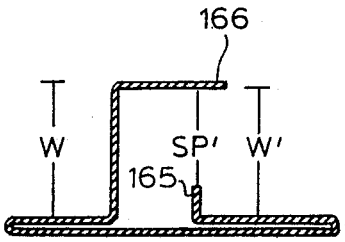
FIG. 31 is a sectional view of the cold-rolled-formed metal ceiling furring strip seen in FIG. 22.

In general, it is to be realized that the wall and ceiling system of the invention is adaptable to any thickness of conventional wall board, plywood, unfinished and prefinished paneling, gypsum board, prefinished Marlite board, or any other board rigid enough to be used in the construction of walls and ceilings. Also to be recognized is that the invention furring strips may be attached to wood or metal studs and may, for example, be milled from solid sections of wood or other material as illustrated, for example, in FIG. 5. Alternatively, the furring strips may be cold-roll-formed from sheet metal as illustrated by furring strip 60 in FIG. 11 having respective shallow and deep channels 62, 64 with depth X being substantially half depth Y. Similar examples of cold-rolled-formed strips according to the invention can be seen in FIGS. 18, 21 and 31 later referred to.

Figure 12:
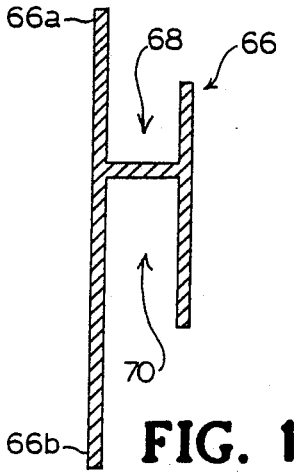
FIG. 12 is an end cross-sectional view of a typically metal or plastic extruded type of furring strip suited to the invention and also generally of the FIG. 10 H-shaped configuration.

FIG. 12 illustrates an extruded furring strip 66 extruded from a plastic such as PVC (polyvinyl chloride) or a metal such as aluminum with respective shallow and deep channels 68, 70. In another form, furring strip 72 (FIG. 13) represents a furring strip molded from wood chips or other moldable material with respective shallow and deep grooves 74, 76 and a rounded outside surface 73 simulating a round molding.

Figure 13:
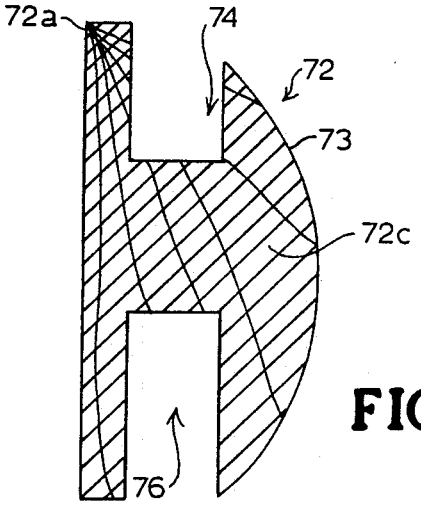
FIG. 13 is an end cross-sectional view of a typically metal, plastic or wood composition molded generally H-shaped type of furring strip suited to the invention and having an outer curved surface for appearance.

Various ways of securing the furring strips may be employed such as glue, nails, screws or the like. For example, stud securing nails may be installed through webs 60*a*, 60*b* (FIG. 11) of roll formed furring strip 60 (FIG. 11) or webs 66*a*, 66*b* (FIG. 12) of extruded furring strip 66. Also to be noted is that sections 53, 55 of strip 49, webs 60*a*, 60*b* of furring strip 60 as well as webs 66*a*, 66*b* of furring strip 66 serve to provide a backing for relatively thin and less than rigid wallboards. A nail through body portion 72*c* of furring strip 72 (FIG. 13) may, for example, be used to secure the strip to the stud. Nails or other fastening means suited to metal or wood studs may also be passed through web 72*a* of furring strip 72 (FIG. 13).

Having described the invention in reference to FIGS. 1–13, broader and other aspects of the invention are described in reference to FIGS. 14–34.

Figures 14, 15A:
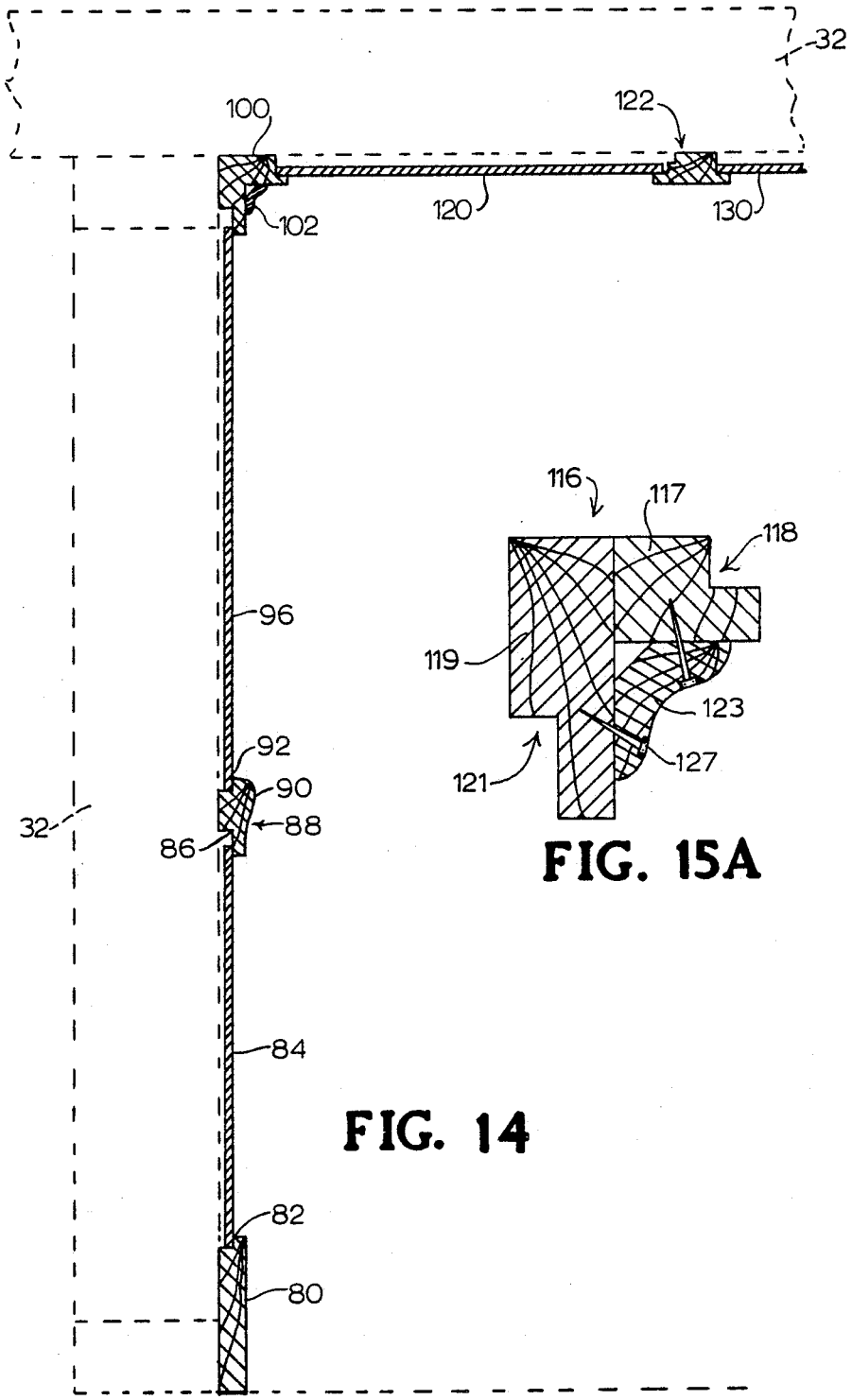
FIG. 14 is a sectional view of a portion of a sidewall and ceiling construction utilizing specially formed baseboard, chair rail and crown moldings according to the invention with other views and forms of the furring strips, chair rail and crown moldings suited to the FIG. 14 construction being shown in FIGS. 15, 15A, 16, 17 and 28.
FIG. 15A is a sectional view of another type of built-up crown molding suited to the FIG. 14 construction.

Making reference next to FIGS. 14–17 and 28, there is shown in FIG. 14 a baseboard 80 having a shallow rabbet 82 supporting the bottom straight edge of wainscot panel 84 with a straight upper edge of panel 84 being captured by a relatively deep rabbet 86 forming part of a solid chair rail 88. Chair rail 88 has a molded outer face surface 90 simulating the appearance of a conventional chair rail and includes a relatively shallow rabbet 92 providing support for the bottom straight edge of upper wall panel 96. Panels 84 and 96 provide access in the manner previously explained. Chair rail 88 thus effectively serves the same purpose as the previously described furring strips and also provides a simulated chair rail. A completely accesible but conventional appearing sidewall is provided. In the alternative form of chair rail 88(*a*) seen in FIG. 17, the outer curved face is formed by a nailed-on piece 90(*a*) secured by nails 91.

Figure 15:
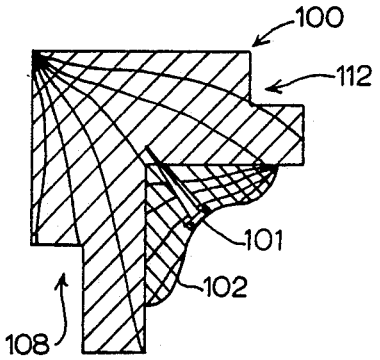
FIG. 15 is a sectional view of a crown molding of the type shown in the construction of FIG. 14.
Figure 16:
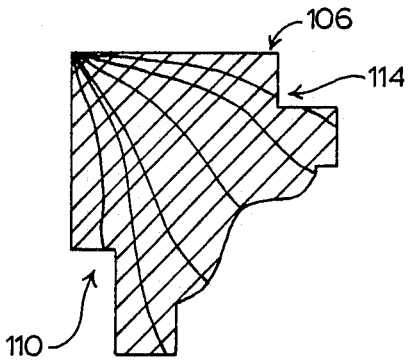
FIG. 16 is a sectional view of another type of crown molding suited to the construction of FIG. 14.
Figure 17:
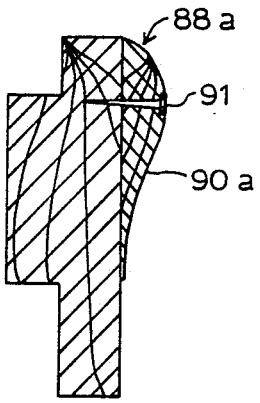
FIG. 17 is a sectional view of another type chair rail suited to the construction of FIG. 14.

A crown mold 100 is fitted with a curved mold piece 102 secured by nails 101 as in FIGS. 14 and 15 or may be formed as a solid crown mold 106 as in FIG. 16. The crown molds 100 and 106 have respective relatively deep vertical rabbets 108, 110 and relatively shallow horizontal rabbets 112, 114. In the illustration of FIGS. 14, 15, 16 and 28 it will be noted that the relatively deep rabbet 108 captures the upper straight edge of wall panel 96 and the relatively shallow horizontal rabbet 112 captures the left straight edge of ceiling panel 120, the right straight edge of which is captured by the curb 125 of the relatively deep rabbet 124 of furring strip 122 seen in FIGS. 14 and 28. It will thus be seen that crown molds 100 and 106 serve the conventional purpose of a crown mold but additionally provide means for gaining immediate access to work areas behind panels supported by the crown molds. Also to be seen is that access both below and above chair rail 88 is available.

In another form of crown mold 116 seen in FIG. 15A, a horizontal plate 117 is formed with a relatively shallow rabbet 118 and is secured to a vertical plate 119 having a relatively deep rabbet 121 and to which is secured a molding 123 with nails 127. From prior explanation, it will be readily understood that crown mold 116 functions in the same manner as previously explained with reference to crown molds 100 and 106.

Furring strip 122 (FIGS. 14 and 28) is designed with an relatively deep rabbet 124 having a curb 125 enabling panel 120 to be trapped by curb 125 but be given freedom to move when lifted up to the level of upper rabbet 126, with the depth D (FIG. 28) being essentially equivalent to the relatively deep rabbet 30 of FIG. 5 and the depth D' being essentially equivalent to the relatively shallow rabbet 28 of FIG. 5. It will be observed that the curb 125 provided by rabbet 124 of the solid furring strip 122 of FIG. 28, by the curb 189 of rabbet 190 of the formed furring strip 186 of FIG. 29, by curb 163 of formed strip 164 of FIG. 21 or by curb 165 of formed strip 166 of FIG. 31 resist panel dislodgement due to vibration. At the same time any panel may be easily removed as for example by lifting panel 120 to clear the curb 125 of rabbet 124. To complete the description of FIG. 14, the left straight edge of ceiling panel 130 is supported by the relatively shallow rabbet 132 of furring strip 122.

Figure 18:
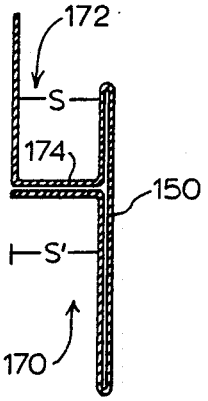
FIG. 18 is a sectional view of a cold-rolled formed metal furring strip used in the construction of FIG. 22.
Figure 19:
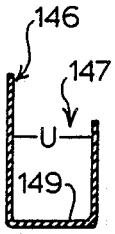
FIG. 19 is a sectional view of a bottom support or lower wall stop furring strip used in the construction of FIG. 22.
Figure 20:
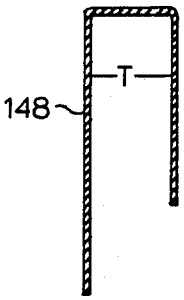
FIG. 20 is a sectional view of a top support or upper wall stop furring, strip used in the construction of FIG. 22.
Figure 22:
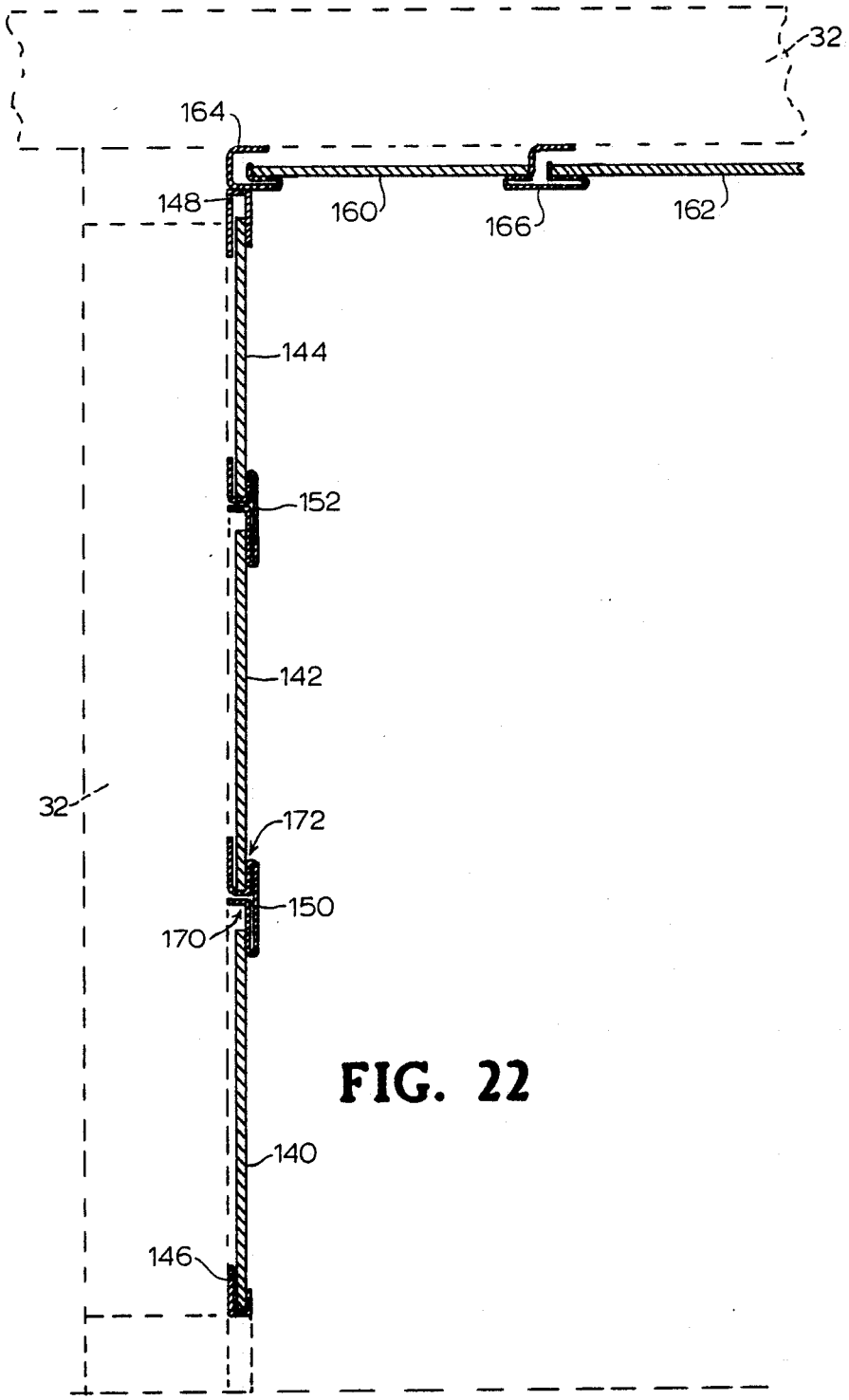
FIG. 22 is a sectional view of a portion of a sidewall and ceiling construction utilizing those specially formed components shown in FIGS. 18–21 and 31.

In another aspect of the invention, illustrated in FIGS. 18–22 and 31, vertical wall panels 140, 142 and 144 are supported by lower wall stop furring strip 146, upper wall stop furring strip 148 and sidewall furring strips 150, 152. Ceiling panels 160, 162 are supported by finishing channel or end furring strip 164 and furring strip 166. Other furring strips 166 would of course appear if the full ceiling wall were to be shown. Lower furring strip 146 (FIG. 19) provides a relatively shallow slot 147 which receives the bottom straight edge of panel 140 for resting on bottom wall 149 (FIG. 19). The straight upper edge of panel 140 seen in FIG. 22 is captured by the relatively deep rabbet 170 of furring strip 150 whereas the straight lower edge of panel 142 is captured by the relatively shallow slot 172 (FIGS. 18 and 22) and is supported on bottom wall 174 formed in furring strip 150. Furring strip 150 is otherwise formed as seen in FIG. 18.

Figure 23:
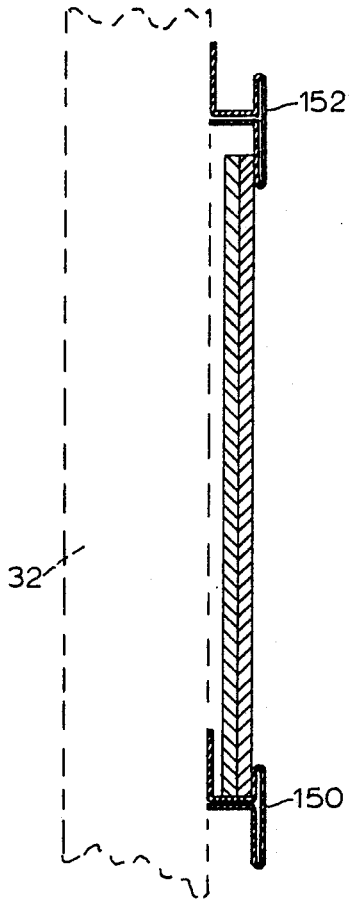
FIG. 23 is a sectional view of a panel-furring strip arrangement enabling one panel to slide over the other for access.
Figure 24:
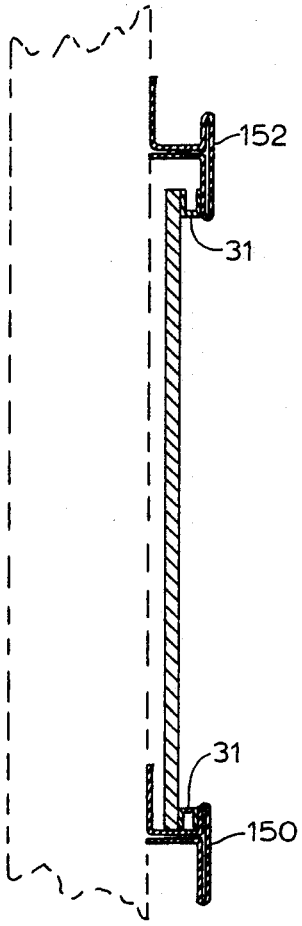
FIG. 24 is a sectional view of the panel-furring strip arrangement of FIG. 23 with a single panel and upper and lower removeable spacer strips.
Figure 25:
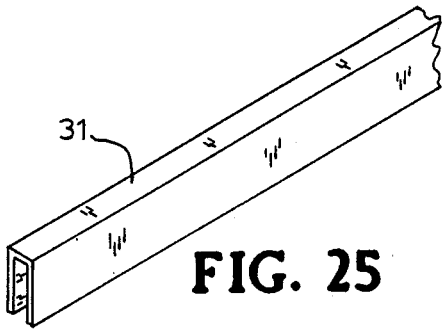
FIG. 25 is a perspective view of a resilient metal or plastic formed spacer strip such as employed in FIG. 24.

While only single panels are shown in FIG. 22, dimensions S and S' (FIG. 18) may be made either slightly more than the panel thickness to permit lifting out of the panel or sufficiently wide to allow one panel to slide over the other when moved parallel to the direction of the strips to gain access as in FIG. 23 or to permit use of a removable spacer strip 31 (FIG. 25) when desired as in FIG. 24. Dimensions T (FIG. 20) and U (FIG. 19) may also be of similar size for the same purpose. In a similar manner, dimension V (FIG. 21) for the ceiling end furring strip 164 and dimensions W and W' (FIG. 31) for the ceiling furring strip 166 may be formed so as to permit sliding of one ceiling panel over another. Also to be observed is the free space SP in end furring strip 164 and free space SP' in ceiling furring strip 166 (FIG. 31) to facilitate removal and repositioning of panels when required.

Figure 26:
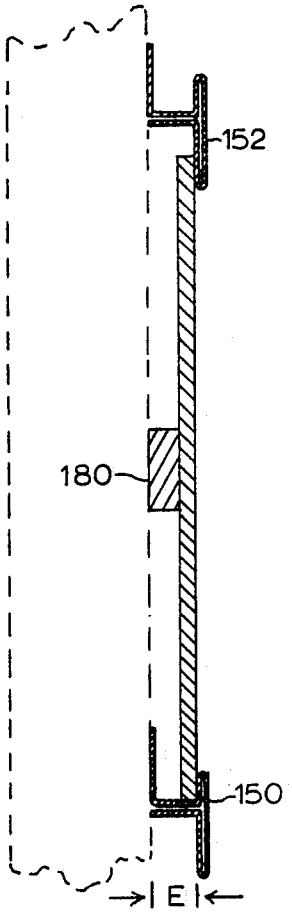
FIG. 26 is a sectional view similar to FIG. 24 but with a building frame secured auxiliary strip for maintaining the single panel positioned.
Figure 27:
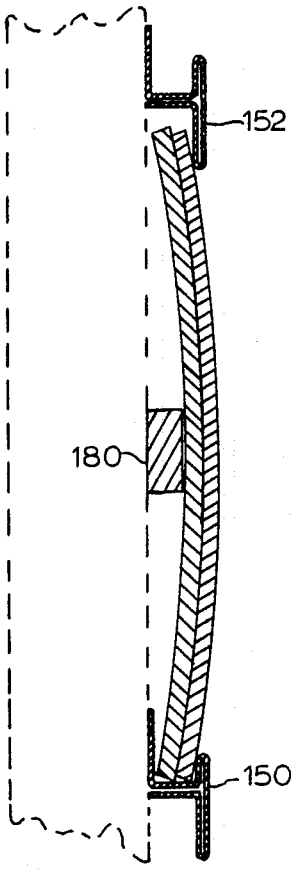
FIG. 27 is a sectional view similar to FIG. 26 but with a building frame secured auxiliary strip located behind two flexed panels one of which has been positioned over the other.

In a further aspect of the invention, an auxilary strip 180 of substantially the same thickness as the panel may be employed behind a single panel as in FIG. 26 and to permit flexing and sliding of one panel over another as in FIG. 27. Dimension E in FIG. 26 is made slightly greater than twice the thickness of the panel. Such arrangement tends to prevent the appearance of a visual crack between the backside of the flange on the furring strip and the wall panel.

Figure 29:
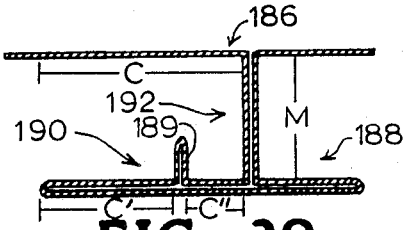
FIG. 29 is a sectional view of a cold-rolled-metal formed ceiling furring strip having a vibration resisting curb according to the invention.

In another aspect, the modified furring strip 186 shown in FIG. 29 is formed with a relatively shallow slot 188, a relatively deep rabbet 190 having curb 189 and within a relatively overall deep slot 192. It will be readily understood from what has been explained that by initially engaging one panel edge in rabbet 190 against curb 189 that this curb arrangement effectively provides a means to prevent dislodgement due to vibration but readily permits the panel edge more freedom to shift when moved into slot 192.

Figure 30:
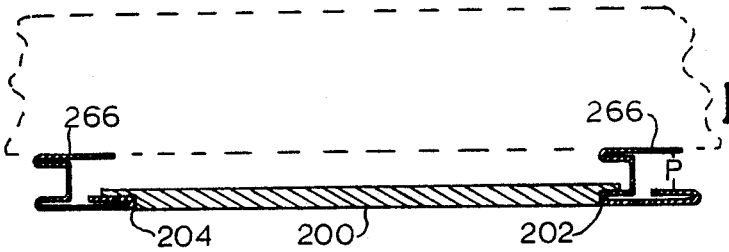
FIG. 30 is a sectional view of a construction assembly utilizing a modified panel and modified cold-rolled-formed ceiling furring strip according to the invention.

In another aspect of the invention, FIG. 30 illustrates a modified panel 200 having straight notched edges 202, 204 and shown nested in a pair of cold-rolled-formed furring strips 266 of the general shape previously referred to in reference to FIG. 12. In this arrangement, the dimension P (FIG. 30) is selected to permit sliding of one panel over another in the direction of the strips with the notch arrangement eliminating the need for the previously discussed curb in that the illustrated ceiling panel 200 would have no tendency to slide once installed.

Figure 32:
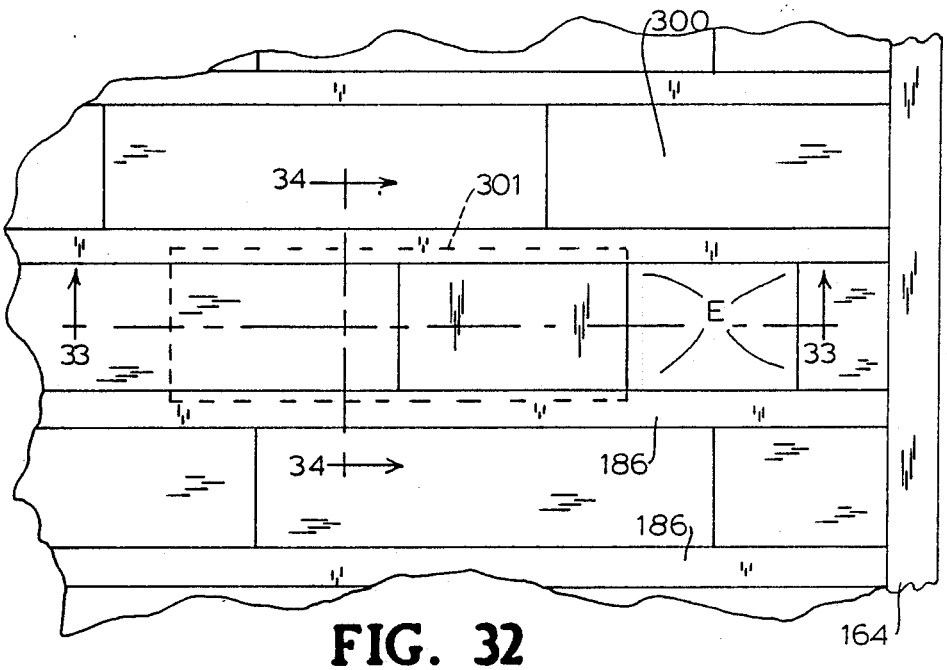
FIG. 32 is a partial ceiling plan view of a ceiling constructed according to the invention using ceiling panels of random length and randomly spaced with one panel shown opened for access.
Figure 33:
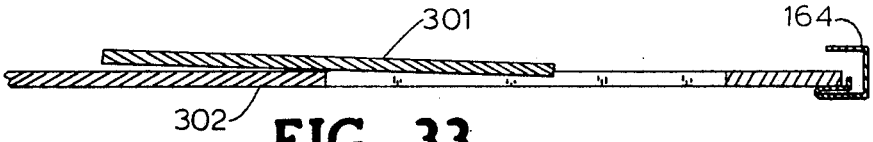
FIG. 33 is a sectional view taken along line 33-33 of FIG. 32.
Figure 34:
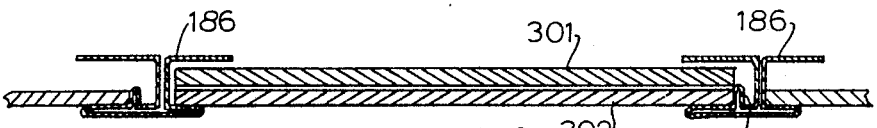
FIG. 34 is a sectional view taken along line 34-34 of FIG. 32.

FIG. 32 illustrates a portion of a ceiling wall constructed according to the invention using panels 300 of random length and randomly spaced with panel 301 shown slid over another panel 302 to provide access to the point of entry E. In the manner previously explained the ceiling strip 164 previously referred to in connection with FIG. 21 supports one end of the panels as seen in FIG. 33 whereas other ceiling strips 186 previously referred to in connection with FIG. 29 support side edges of the panels as seen in FIG. 34 and utilizing the referred to curbs 189 to limit movement of the panels and also to position the panels such that substantially equal edge panel surfaces of each panel rest on the supporting strip surfaces for such edge surfaces.

While shown in a variety of forms, in the principal form of the invention where the furring strip or other building component strip has two panel support surfaces extending outwardly from appended perpendicular stop surfaces, one of such panel support surfaces is always at least twice the depth of the other, such panel support surfaces are coplanar and both accept straight panel edges in continuous contact. Where a curb is employed such as curb 189 in FIG. 29, the depths C, C' and C'' are selected to provide clearance for easy removal of the panel.

In summary, it will be seen that the invention provides an overall system readily adapted to either ceiling or sidewall construction in which the panels are readily removed by either a slight sidewise and outward tilting action or by a slight lifting and outward tilting action. Accessibility is gained either by sliding or removing a panel. The advantages to be recognized are summarized by the following:

(a) Basically only two components namely panels and furring strips both of which may be of uniform construction, are required to construct all or a major portion of either a ceiling wall or a sidewall.

(b) Immediate accessibility to any selected point of entry behind a sidewall or above a ceiling wall is available simply by removing or repositioning a panel.

(c) The panels require no edge treatment and are provided with straight edges.

(d) The panels are not required to be screwed. Thus, clips, anchors, nails and the like are not required to secure the panels.

(e) The system adapts to any kind of structure to which the furring strips can be fixed and to substantially any kind of pre-cut or on-site cut panel.

(f) A visually gap free surface is provided. Gap seals or the like are not required.

(g) Slight variations in panel sizes and furring strips are readily accommodated and different kinds of panels may be used together.

(h) Panel edges have continuous support and contact with furring strip surfaces along both long edges of the wall and ceiling panels.

(i) Panels tend not to vibrate out of furring strips.

(j) No special tools are required to gain access behind or above the panels.

(k) Panels are self-aligning thus directional alignment is not required nor are adjustments required for properly locating the panels.

(l) The system adapts to either new construction or to remodeling, modernization, retrofitting and similar work and can be applied over existing finished walls and ceilings.

(m) The construction of the system adapts to whole or partial walls and ceilings and readily blends with existing non-accessible walls and ceilings.

(n) Panel joints may be butted together or hidden from view without impairing accessibility.

(o) The minimum ratio of 2:1 of the deep rabbet to the shallow rabbet tolerates some error in furring strip spacing or panel size without impairing the overall utility of the invention system.

(p) Furring strips such as exemplified, for example, in FIGS. 11–13, 18, 21, 29 and 31 may be readily cold-roll-formed of metal.

(q) Where a chair rail component of the invention is employed as in FIG. 14, accessibility is gained both below and above the chair rail.

Figure 28:
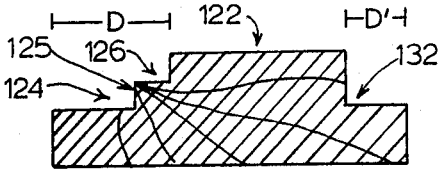
FIG. 28 is a sectional view of the wood formed type of ceiling furring strip having a vibration resisting curb as employed in the construction of FIG. 14.

(r) The form of ceiling furring strip seen in FIG. 28 and 29 provide integral vibration resisting curbs.

(s) By proper choice of furring strip, either lift out or sliding access may be gained using only one size of furring strip.

(t) In the configuration of FIG. 8, either inside or outside corners and either vertical or horizontal corners are accommodated.

(u) A minimum number of standardized components enable either a ceiling wall or sidewall to be constructed with complete access.

(v) Progressive removal of panels is not required to gain access to a selected point of entry.

I claim:

1. A system for constructing at least a major portion of a selected interior ceiling wall of a building in a manner providing immediate access to the utility space above the ceiling wall at any selected point of entry, comprising:

(a) frame members fixed to the selected ceiling wall forming a utility space therebetween and suitable for directly supporting furring strips thereon;

(b) a plurality of pairs of parallel furring strips fixed directly to said frame members, each pair of strips providing a pair of continuous, opposed, parallel, co-planar panel retaining surfaces, the first of said panel retaining surfaces being of relatively narrow uniform width and the second of said panel retaining surfaces being of relatively wide uniform width not less than twice the width of the first, each strip having appended portions oriented perpendicular to the plane of each said panel retaining surface and providing a smooth straight continuous surface for abutting, trapping and aligning a straight, flat edge of a panel retained by and located entirely above the respective said retaining surface to which such portion is appended; and (c) a plurality of rectangular flat panels, each of said panels being formed with straight flat unnotched edges on all sides thereof and each being mounted with a selected pair of opposed flat panel side surfaces fully and continuously loosely engaging and located above a selected mating pair of said retaining surfaces in normal service and positioned so as to be trapped by said other appended portions of the pair of furring strips forming said selected pair of panel retaining surfaces to form the selected said ceiling wall, said furring strips providing external surface portions operative to cover gaps between respective edges of adjoining said panels to provide an externally visually gap free appearance, each said panel having freedom to slide toward the wider one of the panel retaining surfaces above which such panel is mounted and to tilt to be completely removed from said furring strips to provide access to the utility space above such panel and without requiring removal of any other of said panels and also while located above said selected pair of panel retaining surfaces having freedom to slide lengthwise of said selected pair of panel retaining surfaces during installation of said panel, said furring strips providing the sole means of support for said panels in the construction.

2. A system as claimed in claim 1 wherein said furring strips are of T-shaped cross section and are affixed to said frame members such that each said pair of panel retaining surfaces form interior surfaces of said strips.

3. A system as claimed in claim 1 wherein said furring strips are formed as extrusions.

4. A system as claimed in claim 1 wherein said furring strips are roll formed of sheet metal.

5. A system as claimed in claim 1 wherein said furring strips are molded.

6. A system as claimed in claim 1 including auxiliary strips fixedly mounted to provide backing support for said panels.

7. A system as claimed in claim 1 wherein said furring strips are formed of wood.

8. A system as claimed in claim 1 wherein the width of said appended portion is sufficient to enable one panel to be slid over another panel when moved parallel to said strips.

9. A system as claimed in claim 1 wherein each said second panel surface for each said furring strip utilized for said ceiling wall includes a first said appended portion of low height operative as a smooth, flat, continuous curb for restricting movement of the ceiling panel trapped by such curb and a second said appended portion located so as to permit such ceiling panel to be slid over such curb when being positioned for removal to gain access above such ceiling panel.

10. A system as claim in claim 1 wherein the width of said appended portions permits said panels to be either removed or slid one over the other to gain access.

* * * * *